US012789954B2

(12) United States Patent
Iwata et al.

(10) Patent No.: US 12,789,954 B2
(45) Date of Patent: Nov. 10, 2026

(54) PERSONAL WATERCRAFT

(71) Applicant: KAWASAKI MOTORS, LTD., Hyogo (JP)

(72) Inventors: Tetsuya Iwata, Akashi (JP); Minoru Kobayashi, Akashi (JP); Toshio Araki, Akashi (JP); Yuki Nakamura, Akashi (JP); Yoshinori Tsumiyama, Akashi (JP); Shota Miwa, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 367 days.

(21) Appl. No.: 18/600,910

(22) Filed: Mar. 11, 2024

(65) Prior Publication Data

US 2025/0282453 A1 Sep. 11, 2025

(51) Int. Cl.

| | |
|---|---|
| ***B63B 34/10*** | (2020.01) |
| ***B63B 11/02*** | (2006.01) |
| ***B63B 17/00*** | (2006.01) |
| ***B63H 25/02*** | (2006.01) |

(52) U.S. Cl.

CPC ..... *B63B 34/10* (2020.02); *B63B 11/02* (2013.01); *B63B 17/00* (2013.01); *B63H 25/02* (2013.01); *B63B 2017/0009* (2013.01); *B63H 2025/022* (2013.01)

(58) Field of Classification Search

CPC ..... B63B 34/10; B63B 17/00; B63B 11/02

See application file for complete search history.

(56) References Cited

U.S. PATENT DOCUMENTS

| | | | | |
|---|---|---|---|---|
| 6,959,660 | B1 * | 11/2005 | Packebush | F16J 15/46 114/55.53 |
| 7,748,334 | B2 * | 7/2010 | Ross | B63B 34/10 114/55.57 |
| 10,214,270 | B1 * | 2/2019 | Berche | B63B 34/10 |
| 10,227,110 | B1 * | 3/2019 | Valence | B63H 11/04 |
| 11,440,631 | B2 * | 9/2022 | Suzuki | B63B 49/00 |
| 2007/0068434 | A1 | 3/2007 | Tsumiyama et al. | |
| 2021/0229778 | A1 * | 7/2021 | Suzuki | B63H 21/14 |
| 2022/0194526 | A1 * | 6/2022 | Araki | B63H 25/02 |
| 2022/0315172 | A1 * | 10/2022 | Champagne | B60N 2/40 |
| 2024/0140580 | A1 * | 5/2024 | Laflamme Lussier | B63H 25/02 |
| 2024/0239470 | A1 * | 7/2024 | Tian | B63B 34/10 |

FOREIGN PATENT DOCUMENTS

| | | | | |
|---|---|---|---|---|
| JP | 2007069851 A | * | 3/2007 | E05D 11/1007 |
| JP | 2007069852 A | * | 3/2007 | |

* cited by examiner

*Primary Examiner* — Daniel V Venne
*Assistant Examiner* — Jovon E Hayes
(74) *Attorney, Agent, or Firm* — XSENSUS LLP

(57) ABSTRACT

A personal watercraft includes a watercraft body provided with a deck, a hood, and a locking mechanism. The deck includes a driver boarding portion and an opening forming portion where an opening is formed forward of the driver boarding portion and an engine room is partitioned below the opening. The hood, to which a steering shaft is attached to cause a handle to be exposed upward, covers the opening from above to allow opening and closing by pivoting with respect to the deck by using a front end supported by the opening forming portion as a fulcrum. The locking mechanism is a mechanism that fixes the rear end of the hood to the deck with the opening closed, and includes a first locking part and a second locking part disposed with spacing in the left-right direction.

20 Claims, 8 Drawing Sheets

PERSONAL WATERCRAFT

FIELD OF INVENTION

The present disclosure relates to a personal watercraft.

BACKGROUND ART

The personal watercraft disclosed in JP 2007-69851 A includes a hood pivotably provided with respect to a deck. The hood pivots with respect to the deck, thereby covering an engine room from above in a way that allows opening and closing. A handle is attached to the hood.

The hood has to maintain the state where the engine room is closed during driving of the personal watercraft in response to the handle operation by the driver.

SUMMARY OF THE INVENTION

An object of the present disclosure is to provide a personal watercraft that can maintain the state where the hood covers the engine room during driving by the driver.

A personal watercraft according to one aspect of the present disclosure includes: a watercraft body provided with a deck including a driver boarding portion and an opening forming portion in which an opening is formed forward of the driver boarding portion and an engine room is partitioned below the opening; a hood to which a steering shaft is attached to cause a handle to be exposed upward, the hood covering the opening from above to allow opening and closing by pivoting with respect to the deck by using a front end supported by the opening forming portion as a fulcrum; and a locking mechanism configured to fix a rear end of the hood with the opening closed to the deck. The locking mechanism includes a first locking part and a second locking part that are disposed with spacing in a left-right direction.

A personal watercraft according to another aspect of the present disclosure includes: a watercraft body provided with a deck including a driver boarding portion and an opening forming portion in which an opening is formed forward of the driver boarding portion and an engine room is partitioned below the opening; a hood to which a steering shaft is attached to cause a handle to be exposed upward, the hood covering the opening from above to allow opening and closing by pivoting with respect to the deck by using a front end supported by the opening forming portion as a fulcrum; an explosion proof valve that is attached to the hood and is opened by an increase in internal pressure of the engine room; and a cover member attached to the hood and covering the steering shaft. The cover member has a shape that covers the explosion proof valve in addition to the steering shaft.

DETAILED DESCRIPTION

An embodiment of a personal watercraft according to the present disclosure will be described below with reference to the drawings. Some drawings include indication of front/rear/left/right/up/down directions. These directions agree with the directions seen from a driver boarding the personal watercraft. The embodiment described below shows an example in which the personal watercraft is a jet-propelled type personal watercraft that navigates on water by the reaction of ejecting a water stream rearward.

Figure 1:
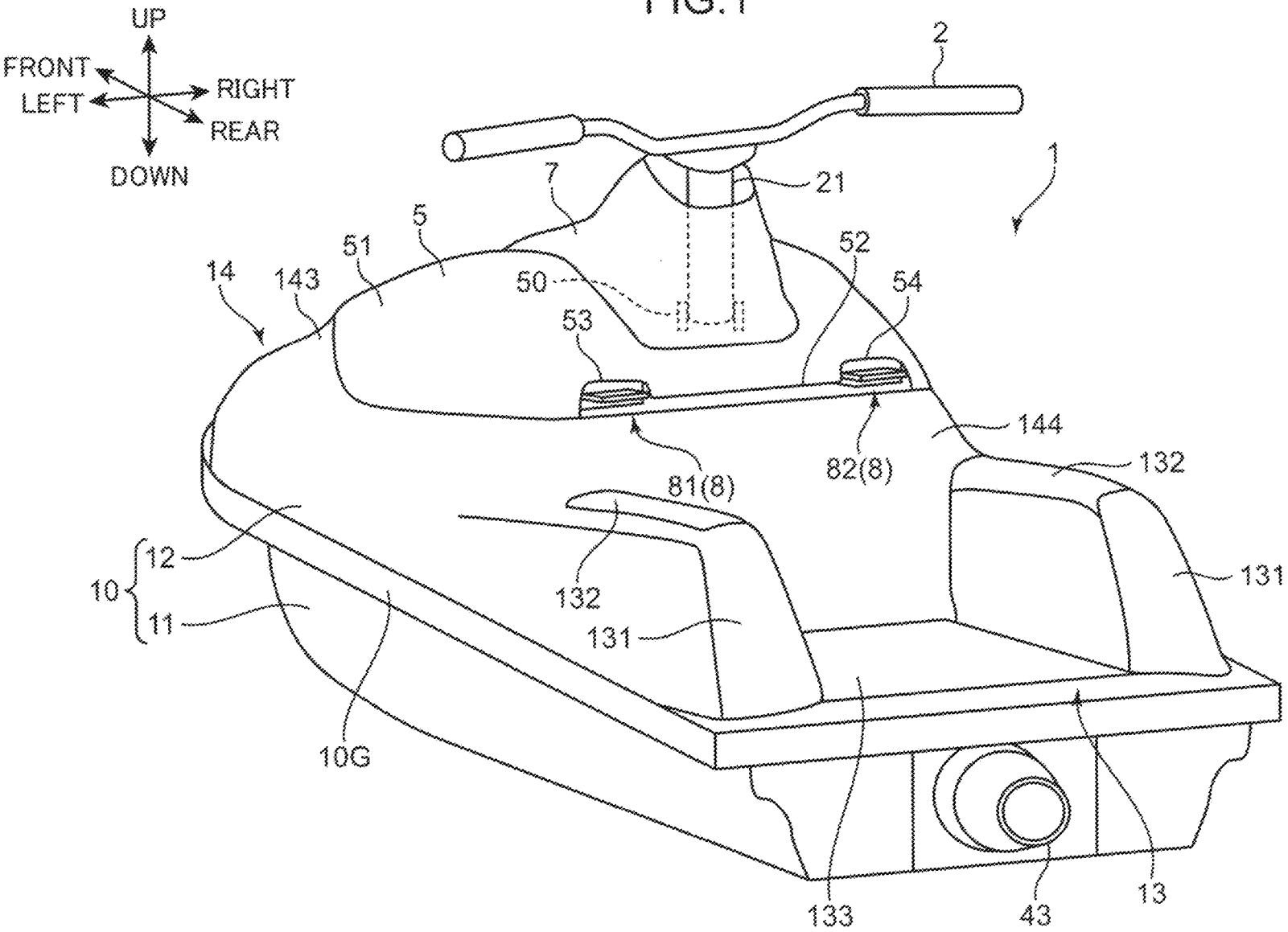
FIG. 1 is a perspective view of a personal watercraft according to one embodiment of the present disclosure, as seen from the rear.
Figure 2:
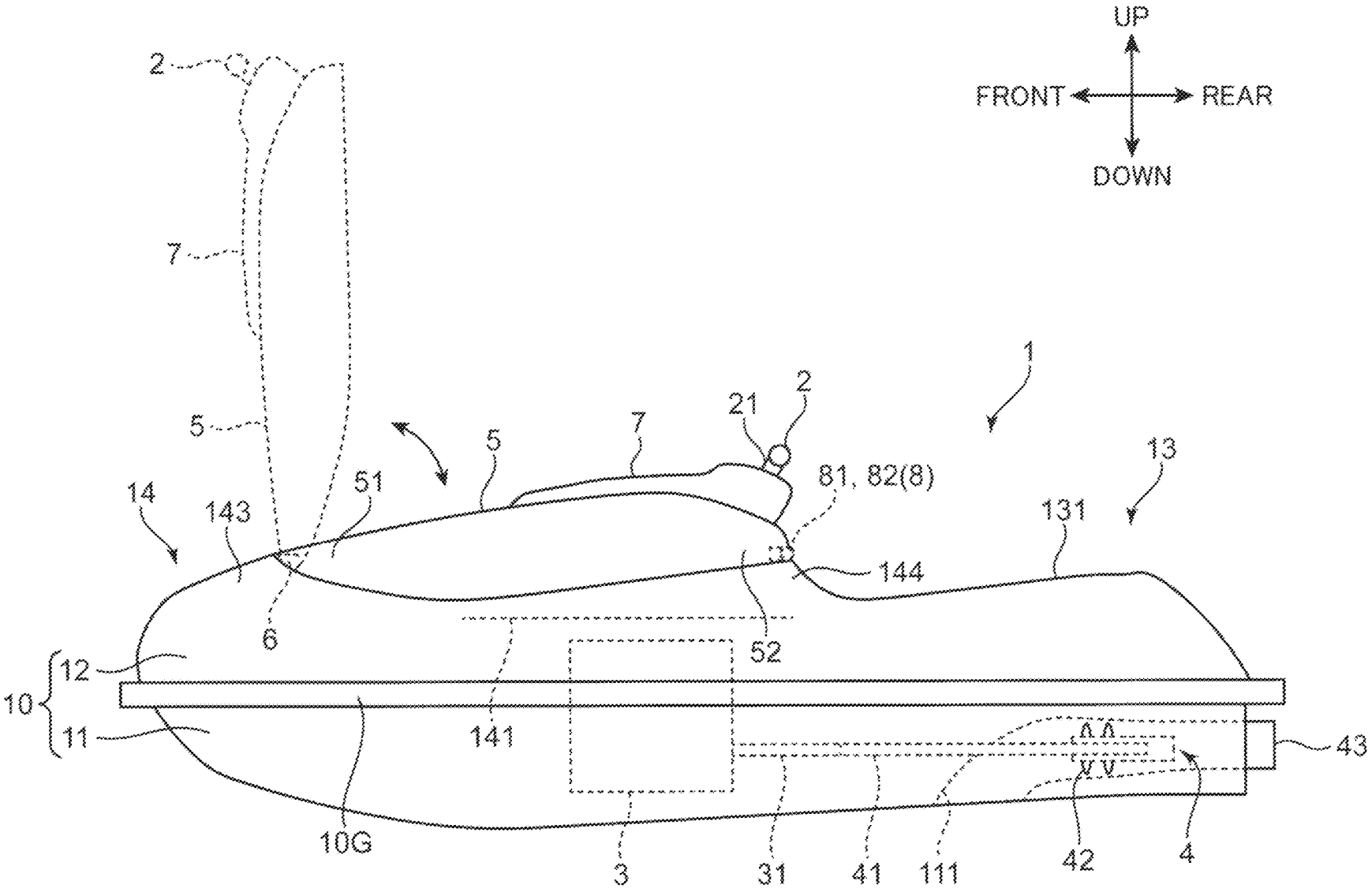
FIG. 2 is a side view of the personal watercraft.

FIG. 1 is a perspective view of the personal watercraft 1, and FIG. 2 is a side view thereof. The personal watercraft 1 is a stand-up type jet-propelled type boat that ejects a water stream rearward and navigates by the reaction thereof. The personal watercraft 1 includes a watercraft body 10, a handle 2, an engine 3, a jet pump 4, a hood 5, and a locking mechanism 8.

The watercraft body 10 includes a hull 11 and a deck 12 that covers the upper surface of the hull 11, and is propelled by a jet water stream. The hull 11 and the deck 12 are connected all around by a gunwale line 10G. The deck 12 includes a driver boarding portion 13 and an opening forming portion 14 located forward of the driver boarding portion 13.

The driver boarding portion 13 has a flat upper surface on which the driver can stand up. Note that for the straddle-type personal watercraft 1, the driver boarding portion 13 is a seat on which the driver straddles. On both left and right sides of the driver boarding portion 13, protruding parts 131 that protrude upward from the upper surface of the driver boarding portion 13 are formed. The protruding part 131 includes a processed area 132 with an anti-slip finish applied. The processed area 132 is an area including the upper surface of the protruding part 131. For example, the driver boards the driver boarding portion 13 from the underwater while holding the protruding part 131. The protruding part 131 includes the processed area 132, making it easier for the driver to board the driver boarding portion 13 while holding the protruding part 131. Alternatively, the processed area 132 may be formed by adhering a matte material 133 to the protruding part 131. The matte material 133 is a member to which a matte finish is applied as an anti-slip finish, and is a member that has a fine uneven shape. The matte material 133 is adhered across the driver boarding portion 13 and the protruding part 131. In this case, the processed area 132 of the protruding part 131 can be formed using the matte material 133 adhered to the driver boarding portion 13.

The opening forming portion 14 is a deck portion where an opening 141 is formed forward of the driver boarding portion 13, and partitions an engine room 142 below the opening 141. The engine room 142 is partitioned across the opening forming portion 14 and the hull 11 below the opening 141. The opening forming portion 14 bulges upward in front of the driver boarding portion 13 such that the opening 141 is located above the driver boarding portion 13. The opening forming portion 14 includes a front wall portion 143 located forward of the opening 141 and a rear wall portion 144 located rearward of the opening 141. The rear wall portion 144 is formed to rise upward from the front end of the driver boarding portion 13.

The hood 5 is attached pivotably with respect to the deck 12 above the opening forming portion 14. The hood 5 pivots with respect to the deck 12 by using a front end 51 supported by the front wall portion 143 of the opening forming portion 14 as a fulcrum, thereby covering the opening 141 from above in a way that allows opening and closing. A steering shaft 21 is attached to the hood 5 such that the handle 2 is exposed upward. The hood 5 includes a steering support part 50. The steering support part 50 supports the lower end of the steering shaft 21 to allow the steering shaft 21 to pivot. The hood 5 can pivot with respect to the deck 12 by using the front end 51 as a fulcrum, while pivoting using the steering support part 50 as a fulcrum is prevented.

The steering shaft 21 is attached to the hood 5 to penetrate the hood 5 in the up-down direction and to be located at the center of the hood 5 in the left-right direction. The steering shaft 21 has an upper end exposed upward from the hood 5 and a lower end supported by the steering support part 50, the handle 2 being attached to the upper end. The handle 2 is operated by the driver in order to steer the personal watercraft 1. The steering shaft 21 pivots in response to the operation of the handle 2 by the driver.

A portion of the steering shaft 21 exposed from the hood 5 is covered by a cover member 7. The cover member 7 is attached to the hood 5 and covers the steering shaft 21 such that the handle 2 is exposed upward.

The engine 3 is installed inside the engine room 142. The engine 3 generates driving force to drive the jet pump 4. The engine 3 is provided with a crankshaft 31 that extends in the front-rear direction inside the hull 11.

The jet pump 4 is disposed rearward of the engine 3 inside the hull 11. To give propulsive force to the personal watercraft 1, the jet pump 4 pressurizes and accelerates water taken into an impeller passage 111 provided in the rear area of the hull 11 and injects the water rearward. The jet pump 4 includes a pump shaft 41, an impeller 42, and a jet nozzle 43. The impeller 42 is attached to the rear end of the pump shaft 41, and the front end of the pump shaft 41 is coupled to the crankshaft 31. The impeller 42 generates the jet water stream by rotating about the axis. The driving force of the engine 3 is transmitted to the impeller 42 via the crankshaft 31 and pump shaft 41. The jet nozzle 43 is disposed rearward of the impeller 42 and ejects the jet water stream generated by the impeller 42. The jet nozzle 43 is pivotable about an axis extending in the up-down direction, and the ejection direction of the jet water stream, that is, the propulsion direction of the personal watercraft 1 is changed to the left or right by the steering of the handle 2.

Figure 3:
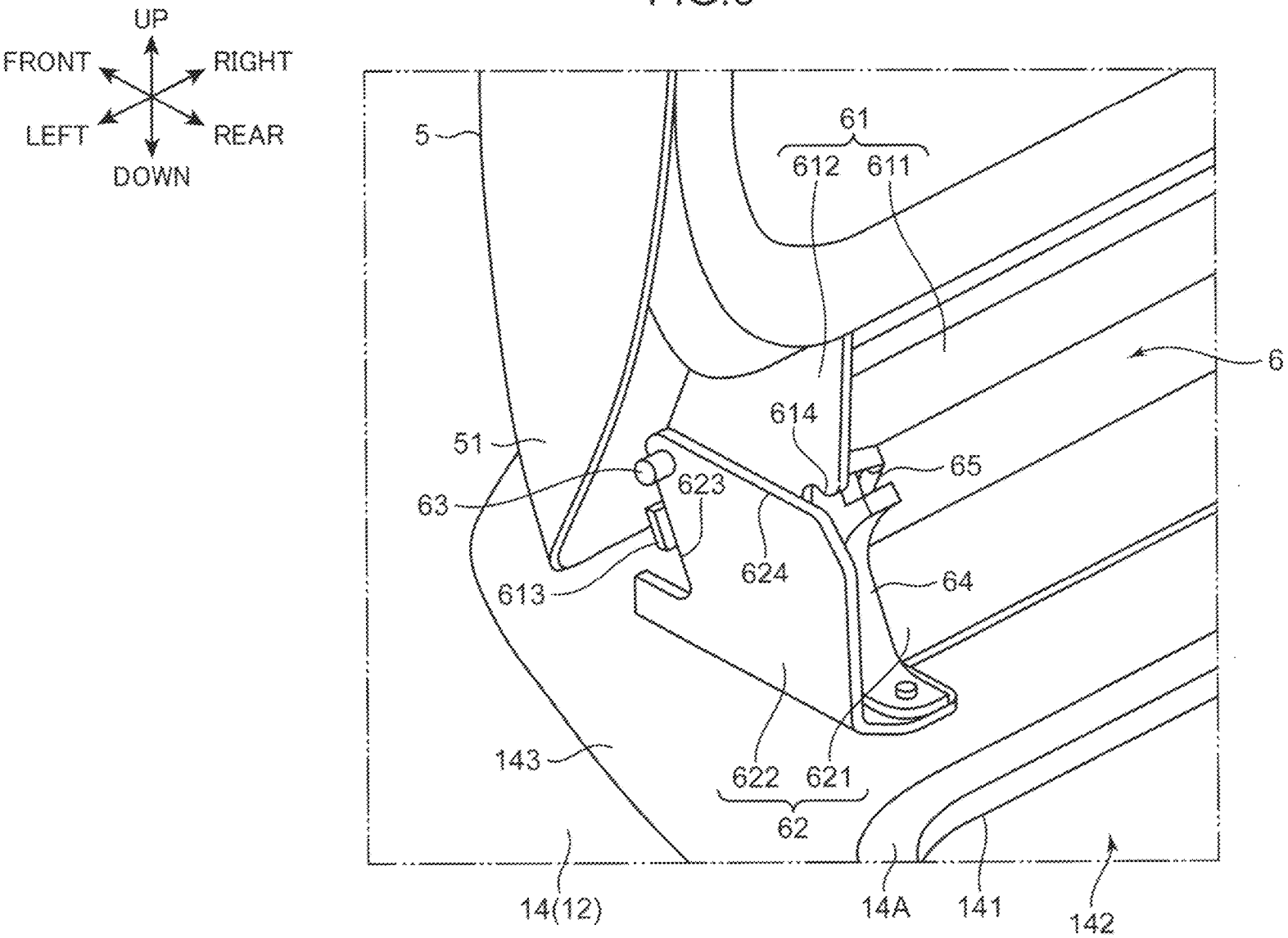
FIG. 3 is a perspective view near a front end of a hood of the personal watercraft as seen from the rear left.
Figure 4:
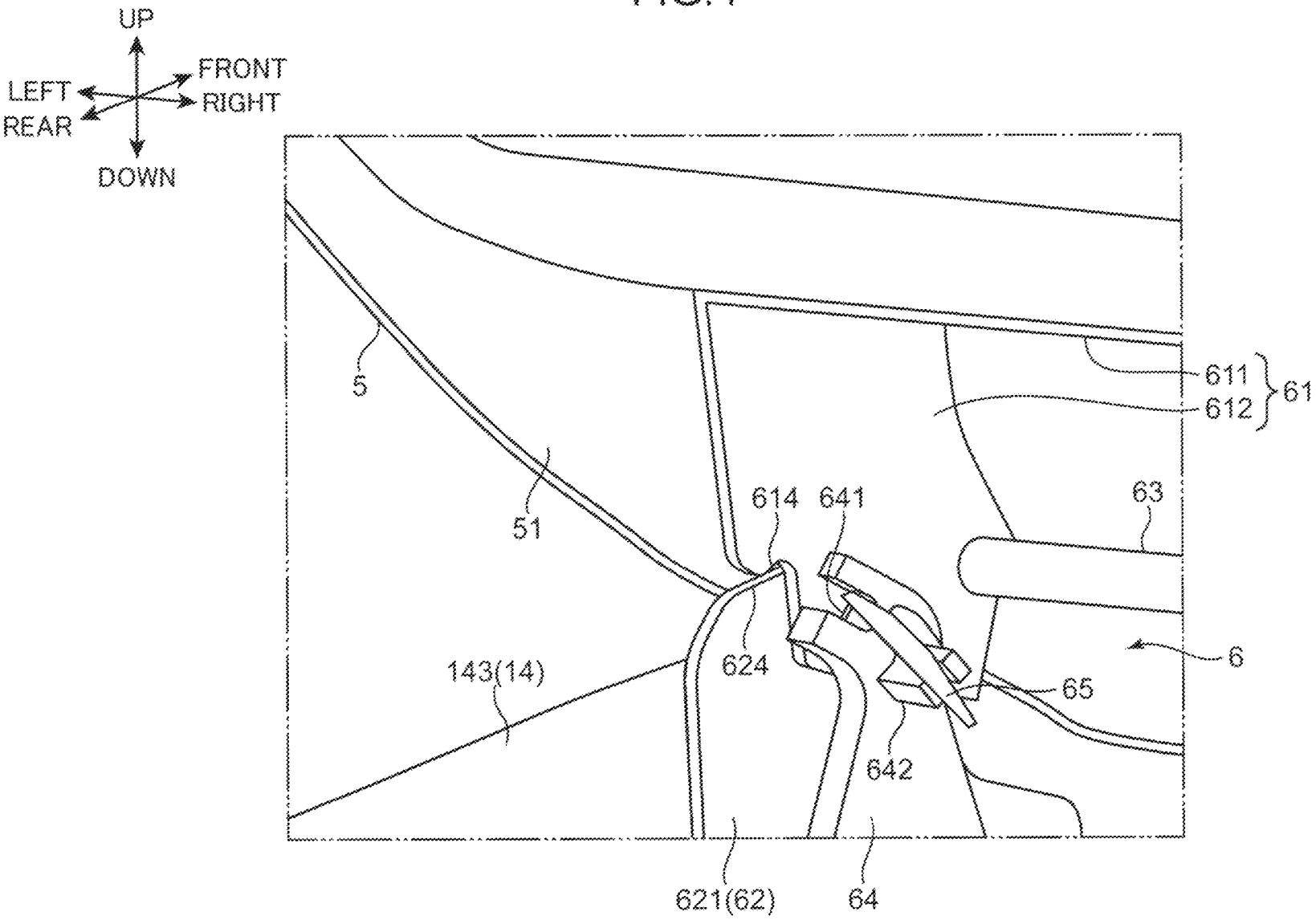
FIG. 4 is a perspective view near the front end of the hood of the personal watercraft as seen from the rear right.

FIGS. 3 and 4 are each a perspective view near the front end 51 of the hood 5. The front end 51 of the hood 5 is fixed to a hinge member 6 attached to the front wall portion 143 of the opening forming portion 14. The hinge member 6 pivotably supports the hood 5. The hinge member 6 includes a hood side bracket 61 fixed to the front end 51 of the hood 5, a deck side bracket 62 fixed to the front wall portion 143 of the opening forming portion 14, and a hinge rotation shaft 63 that pivotably couples the hood side bracket 61 and the deck side bracket 62.

The hood side bracket 61 includes a hood side fixing plate part 611 that extends in the left-right direction along the front end 51 of the hood 5, and a hood side protruding plate part 612 that protrudes from both left and right ends of the hood side fixing plate part 611. The hood side fixing plate part 611 is a part of the hood side bracket 61 that is fixed to the front end 51 of the hood 5. The hood side protruding plate part 612 is a part of the hood side bracket 61 that is coupled to the deck side bracket 62 via the hinge rotation shaft 63.

The deck side bracket 62 includes a deck side fixing plate part 621 that extends in the left-right direction along the front wall portion 143 of the opening forming portion 14, and a deck side protruding plate part 622 that protrudes from both left and right ends of the deck side fixing plate part 621. The deck side fixing plate part 621 is a part of the deck side bracket 62 that is fixed to the front wall portion 143 of the opening forming portion 14. The deck side protruding plate part 622 is a part of the deck side bracket 62 that is coupled to the hood side bracket 61 via the hinge rotation shaft 63.

The hinge rotation shaft 63 couples the hood side bracket 61 and the deck side bracket 62 by penetrating the hood side protruding plate part 612 and the deck side protruding plate part 622.

In the hinge member 6, the hood side bracket 61 is pivotable about the axis of the hinge rotation shaft 63 with respect to the deck side bracket 62. This allows the hinge member 6 to pivotably support the hood 5 with respect to the deck 12 by using the front end 51 as a fulcrum. In addition, the hinge member 6 includes a stopper 613 that regulates the pivoting range of the hood 5. The stopper 613 is provided in the hood side protruding plate part 612, and regulates the pivoting range of the hood 5 by coming into contact with a front end portion 623 of the deck side protruding plate part 622 facing forward. This allows the stopper 613 to regulate the pivoting of the hood 5 beyond the pivoting range, making it possible to prevent the hood 5 from opening excessively with respect to the opening 141. In addition, by providing the hinge member 6 that supports the hood 5 with the stopper 613, it is easier to prevent damage to the hood 5 than in the case where the hood 5 is provided with the stopper.

A support device 64 that supports a holding member 65 is attached near the hood side protruding plate part 612 and the deck side protruding plate part 622 in the front wall portion 143 of the opening forming portion 14. The support device 64 includes a rotating shaft 641 that rotatably supports the holding member 65, and a clamping part 642 that clamps the holding member 65. The holding member 65 can rotate about the axis of the rotating shaft 641 in a state where the clamping by the clamping part 642 is released. The holding member 65 is a member for holding the state where the hood 5 is open. The hinge member 6 includes a fitting part 614 into which the holding member 65 is fitted. The fitting part 614 is provided in the hood side protruding plate part 612, and the holding member 65 is fitted between the fitting part and an upper end portion 624 of the deck side protruding plate part 622 facing upward. By fitting the holding member 65 in the fitting part 614, it is possible to hold the state where the hood 5 is open.

Figure 5:
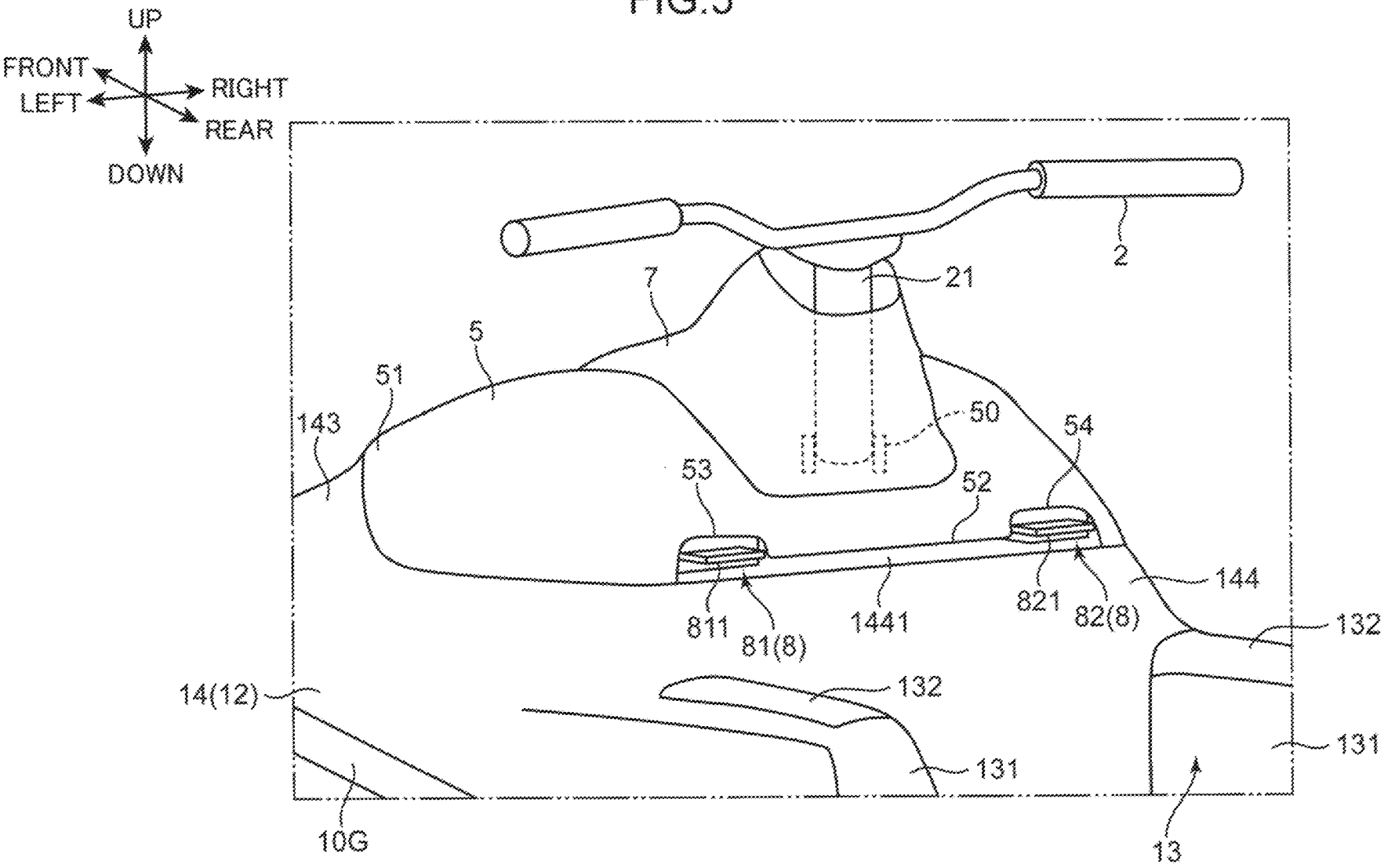
FIG. 5 is a perspective view near a locking mechanism of the personal watercraft as seen from the rear.
Figure 6:
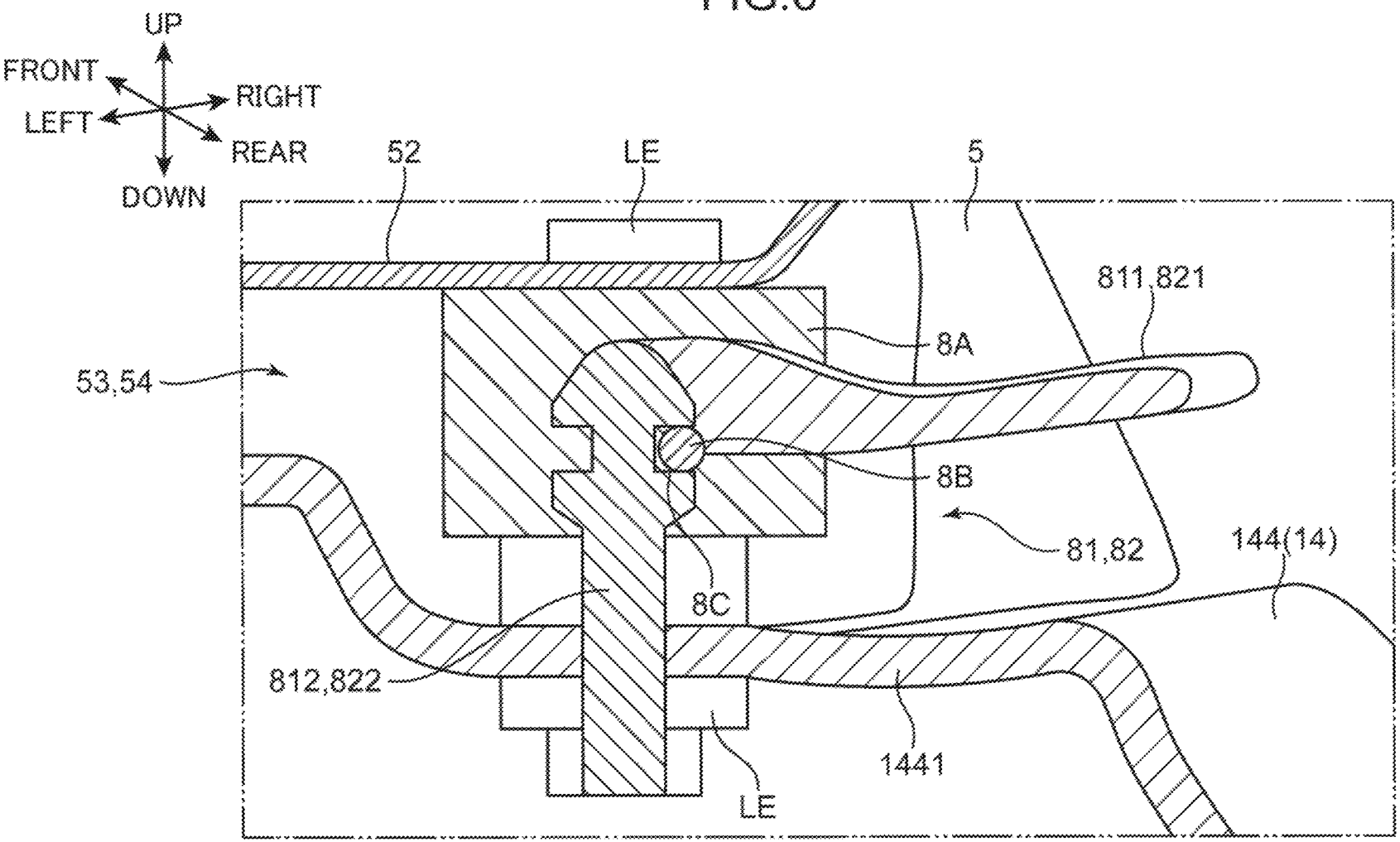
FIG. 6 is a cross-sectional view of the locking mechanism of the personal watercraft.

FIG. 5 is a perspective view near the locking mechanism 8 as seen from the rear. FIG. 6 is a cross-sectional view of the locking mechanism 8. With the hood 5 closing the opening 141, the rear end 52 of the hood 5 is fixed to the deck 12 by the locking mechanism 8.

The locking mechanism 8 is a mechanism that fixes the rear end 52 of the hood 5 to an upper end 1441 of the rear wall portion 144 in the opening forming portion 14. The locking mechanism 8 includes a first locking part 81 and a second locking part 82, which are disposed with spacing in the left-right direction. Note that the locking mechanism 8 only needs to include at least the first locking part 81 and the second locking part 82, and the number of locking parts is not limited to two, but may be three or more.

With the hood 5 closing the opening 141, the rear end 52 of the hood 5 is fixed to the deck 12 by the first locking part 81 and the second locking part 82 disposed with spacing in the left-right direction. This allows the coupling strength between the hood 5 and the deck 12 to be increased. Therefore, even if stress such as torsional stress due to the operation of the handle 2 by the driver is applied to the hood 5, the coupled state between the hood 5 and the deck 12 can be maintained. This allows the state where the hood 5 closes the opening 141 to be maintained during driving in response to the handle operation by the driver.

The first locking part 81 is disposed leftward of the steering shaft 21, and the second locking part 82 is disposed rightward of the steering shaft 21. In this case, the rear end 52 of the hood 5 can be fixed to the deck 12 by the first locking part 81 and the second locking part 82 on both sides of the steering shaft 21. This allows the coupled state between the hood 5 and the deck 12 to be maintained more securely.

Each of the first locking part 81 and the second locking part 82 is disposed rearward of the handle 2. To describe in more detail, each of the first locking part 81 and the second locking part 82 is disposed rearward of the position of the handle 2 when the personal watercraft 1 is traveling straight. Alternatively, each of the first locking part 81 and the second locking part 82 is disposed rearward of the steering support part 50 formed in the hood 5. By disposing each of the first locking part 81 and the second locking part 82 in the above positional relationship with respect to the handle 2, even if stress due to the handle operation by the driver is applied to the hood 5, the coupled state between the hood 5 and the deck 12 can be maintained more securely.

The first locking part 81 includes a first operator 811 attached to the rear end 52 of the hood 5, and a first locking member 812 attached to the upper end 1441 of the rear wall portion 144 in the opening forming portion 14. Similarly, the second locking part 82 includes a second operator 821 attached to the rear end 52 of the hood 5, and a second locking member 822 attached to the upper end 1441 of the rear wall portion 144 in the opening forming portion 14. Each of the first operator 811 and the second operator 821 is supported by an operation body 8A including an engagement part 8B, and is attached to the rear end 52 of the hood 5 by fastening the operation body 8A with a fastener LE. Each of the first locking member 812 and the second locking member 822 includes an engaged part 8C with which the engagement part 8B is engaged, and is fastened to the upper end 1441 of the rear wall portion 144 by the fastener LE.

Each of the first operator 811 and the second operator 821 is operated to switch between the locked state where the rear end 52 of the hood 5 is fixed to the deck 12, and the unlocked state where fixation of the rear end 52 of the hood 5 to the deck 12 is released. Each of the first operator 811 and the second operator 821 transmits the operating force input by the driver to the engagement part 8B, enters the locked state when the engagement part 8B engages with the engaged part 8C, and enters the unlocked state when the engagement of the engagement part 8B with the engaged part 8C is released.

The hood 5 is configured to open the opening 141 when both the first operator 811 and the second operator 821 are in the unlocked state. In this case, in order for the hood 5 to open the opening 141, the first operator 811 and the second operator 821 both need to be in the unlocked state. Therefore, even if one operator enters the unlocked state due to unintended contact by the driver, if the other operator is in the locked state, it is possible to prevent the hood 5 from opening. This makes it easy to prevent the hood 5 from opening undesirably.

Each of the first operator 811 and the second operator 821 is configured to switch to the unlocked state by an operation that involves moving in a pulling direction including upward or rearward. During driving in response to the handle operation by the driver, the first operator 811 and the second operator 821 are unlikely to be operated in the pulling direction. In this case, even if the driver during driving touches the first operator 811 and the second operator 821, the first operator 811 and the second operator 821 are unlikely to enter the unlocked state, making it easy to prevent the hood 5 from opening undesirably.

The rear end 52 of the hood 5 includes a first recess 53 formed at the left corner to be recessed upward while being open rearward and downward, and a second recess 54 formed at the right corner to be recessed upward while being open rearward and downward. Note that the first recess 53 and the second recess 54 may be formed in the rear wall portion 144 of the opening forming portion 14.

The first operator 811 is attached inside the first recess 53 to be accommodated in the first recess 53. Meanwhile, the second operator 821 is attached inside the second recess 54 to be accommodated in the second recess 54. In this case, even if the driver's body nears the first operator 811 and the second operator 821 due to a change in the posture during driving, the surroundings of the first recess 53 and the second recess 54 can prevent the driver's body from touching the first operator 811 and the second operator 821, making it easy to prevent the hood 5 from opening undesirably.

In the present embodiment, each of the first operator 811 and the second operator 821 includes a lever member. In this case, the first operator 811 is attached to the left corner of the rear end 52 of the hood 5, and pivots up and down to allow a posture change between the coupled posture to be coupled with the upper end 1441 of the rear wall portion 144 in the opening forming portion 14, and the uncoupled posture to release the coupling. The second operator 821 is attached to the right corner of the rear end 52 of the hood 5, and pivots up and down independently of the first operator 811 to allow a posture change between the coupled posture to be coupled with the upper end 1441 of the rear wall portion 144 in the opening forming portion 14, and the uncoupled posture to release the coupling. According to such an aspect, since the first operator 811 and the second operator 821 are configured to pivot independently of each other, even if one operator adopts the uncoupled posture due to unintended contact by the driver, the other operator can maintain the coupled posture. This makes it easy to prevent the hood 5 from opening undesirably.

Each of the first operator 811 and the second operator 821 is configured to adopt the uncoupled posture by pivoting upward. During driving in response to the handle operation by the driver, the driver is unlikely to touch such that the first operator 811 and the second operator 821 pivot upward. In this case, even if the driver during driving touches the first operator 811 and the second operator 821, the first operator 811 and the second operator 821 are unlikely to adopt the uncoupled posture, making it easy to prevent the hood 5 from opening undesirably.

Each of the first operator 811 and the second operator 821 has a shape to regulate protrusion from the upper end 1441 of the rear wall portion 144 to the driver boarding portion 13 side with the coupled posture adopted. That is, the rear end of each of the first operator 811 and the second operator 821 is located forward of the rear end of the upper end 1441 of the rear wall portion 144. In this case, the first operator 811 and the second operator 821 can avoid protruding to the driver boarding portion 13 side with the coupled posture adopted. This makes it easy to prevent the driver during driving from touching the first operator 811 and the second operator 821, and to prevent the hood 5 from opening undesirably.

Figure 7:
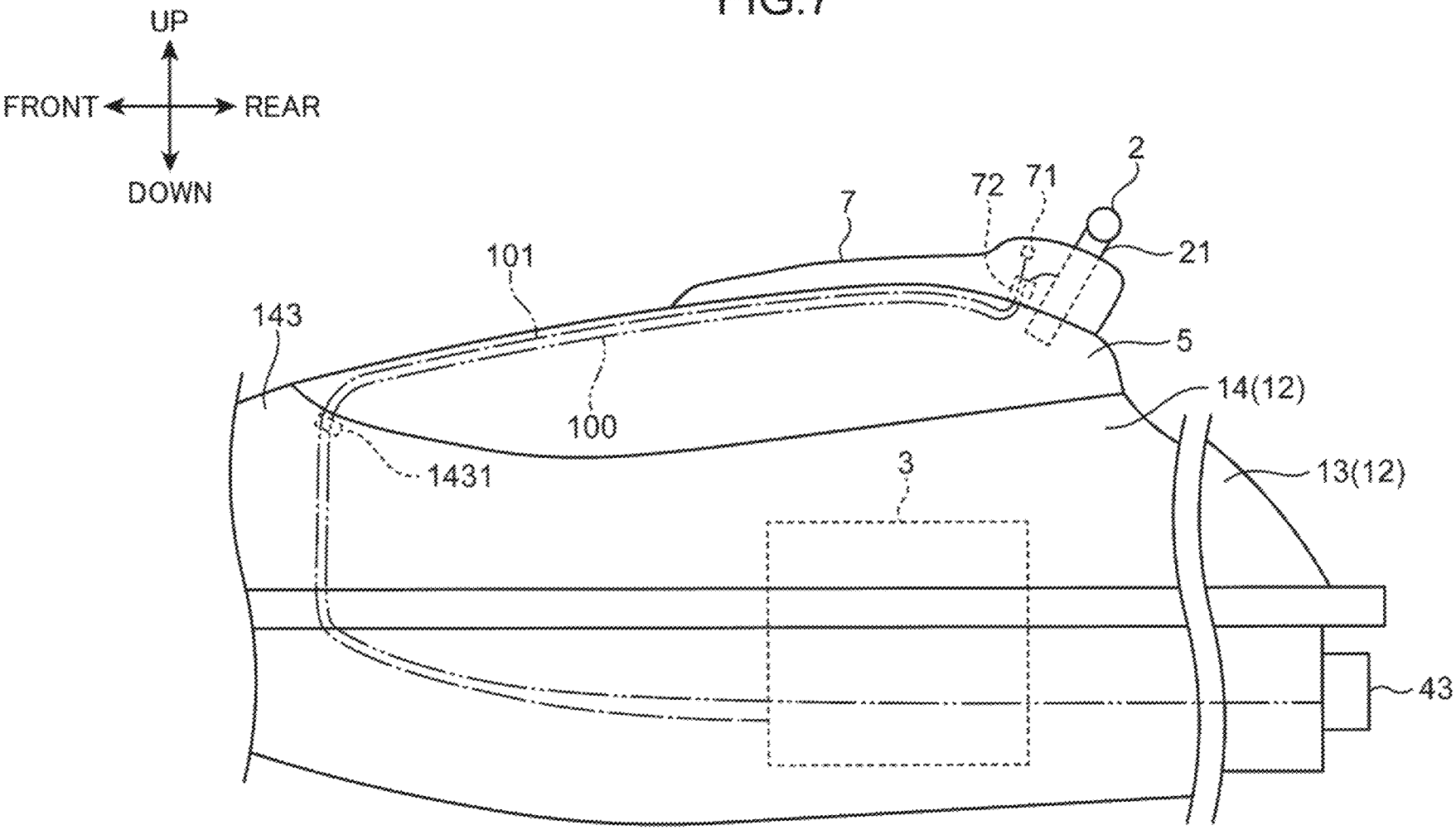
FIG. 7 is a diagram showing the routing state of a cable and a breather pipe in the personal watercraft.

FIG. 7 is a diagram showing the routing state of a cable 100 and a breather pipe 101 in the personal watercraft 1. The personal watercraft 1 further includes the cable 100 and the breather pipe 101. Note that an insertion hole 1431 into which the cable 100 and the breather pipe 101 are inserted is formed in the front wall portion 143 of the opening forming portion 14. The cover member 7 includes an exhaust port 71 that opens downward to the outside, and a cylindrical part 72 that bundles the cable 100 and the breather pipe 101. The cover member 7 has a shape that covers the cable 100 and the breather pipe 101 in addition to the steering shaft 21.

The cable 100 includes a push-pull type steering cable that couples the steering shaft 21 of the handle 2 to the jet nozzle 43. In this case, one end of the cable 100 is connected to the steering shaft 21 inside the cover member 7, passes through the cylindrical part 72, is then routed along the inner surface of the hood 5, and is further guided into the deck 12 through the insertion hole 1431, whereas the other end is connected to the jet nozzle 43.

The breather pipe 101 is a pipe for discharging the air inside the engine 3 installed in the engine room 142 to the outside. One end of the breather pipe 101 is opened to the outside in the cover member 7 located above the hood 5, and the other end communicates with the engine room 142. Specifically, one end of the breather pipe 101 is connected to the exhaust port 71 inside the cover member 7, passes through the cylindrical part 72, is then routed along the inner surface of the hood 5, and is further guided into the deck 12 through the insertion hole 1431, whereas the other end is connected to the engine 3. According to such an aspect, the breather pipe 101 can exhaust the air inside the engine 3 from the exhaust port 71 to the outside. The cover member 7 for covering the steering shaft 21 also covers the breather pipe 101, making it possible to protect the breather pipe 101 and improve the aesthetic appearance of the personal watercraft 1.

Figure 8:
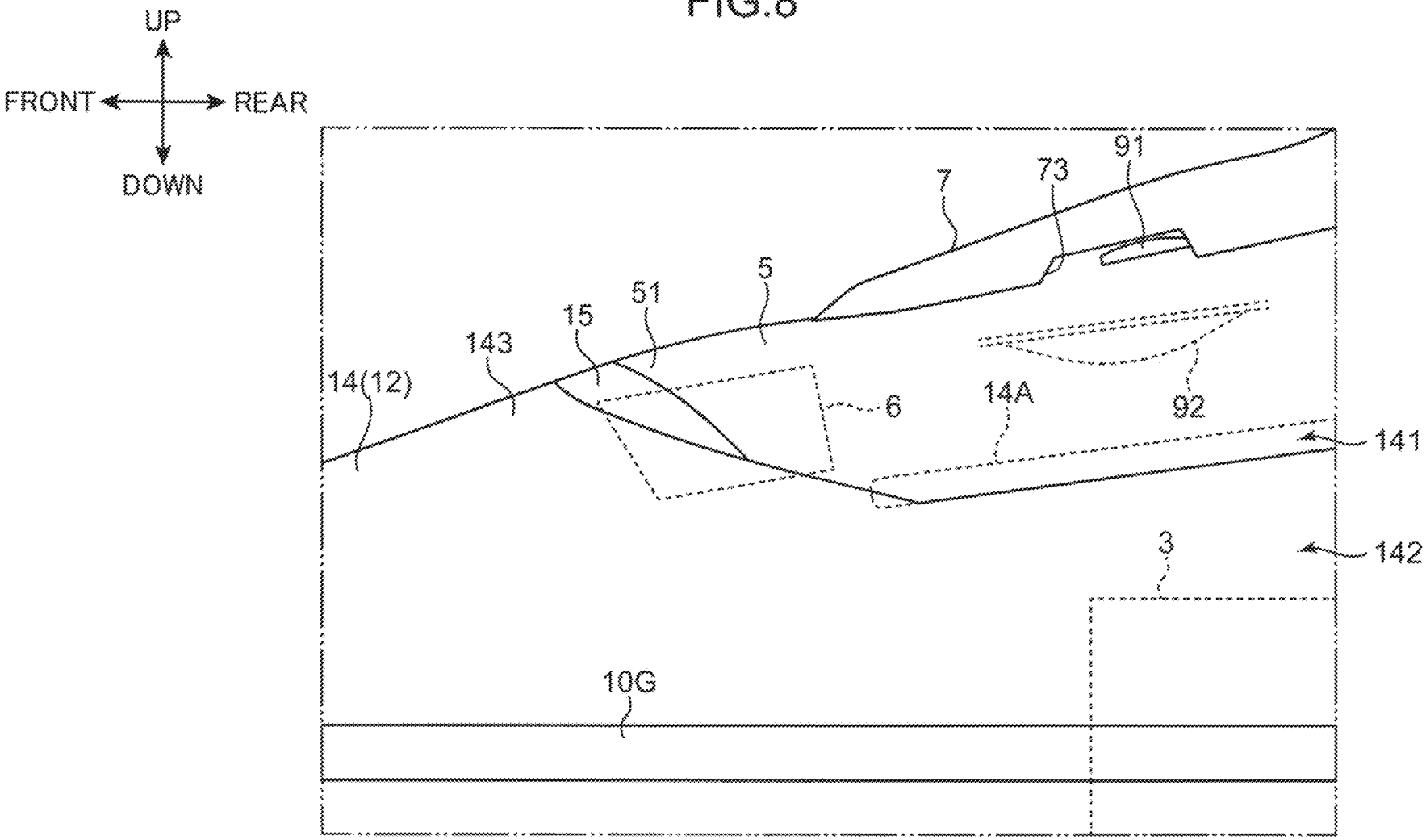
FIG. 8 is a side view near the front end of the hood of the personal watercraft.

FIG. 8 is a side view near the front end 51 of the hood 5 of the personal watercraft 1. The personal watercraft 1 further includes a water intrusion prevention plate 15, an explosion proof valve 91, and an accommodation storage 92. Note that a waterproof sealing member 14A is provided around the entire periphery of the opening 141 at the boundary between the hood 5 and the opening forming portion 14.

The water intrusion prevention plate 15 is disposed between the front end 51 of the hood 5 and the front wall portion 143 of the opening forming portion 14. In this case, the water intrusion prevention plate 15 can prevent water from intruding through the gap between the front end 51 of the hood 5 and the front wall portion 143 of the opening forming portion 14.

The explosion proof valve 91 is a valve attached to the hood 5, and is opened by an increase in the internal pressure of the engine room 142. The cover member 7 has a shape that covers the explosion proof valve 91 in addition to the steering shaft 21. The cover member 7 has a slit 73 formed near the explosion proof valve 91. According to such an aspect, the explosion proof valve 91 is attached to the hood 5, making it possible to suppress the stress applied to the hood 5 as the internal pressure of the engine room 142 increases by opening the explosion proof valve 91. This makes it possible, when the internal pressure of the engine room 142 increases, to suppress coupling force between the hood 5 and the deck 12 necessary to prevent the hood 5 from opening and to maintain the state where the hood 5 closes the engine room 142. In addition, the cover member 7 for covering the steering shaft 21 also covers the explosion proof valve 91, making it possible to protect the explosion proof valve 91 and to improve the aesthetic appearance of the personal watercraft 1.

The accommodation storage 92 is a member attached to the internal surface of the hood 5, and is capable of storing goods. According to such an aspect, it is possible to take out goods from the accommodation storage 92 with the hood 5 open, and to prevent the goods inside the accommodation storage 92 from being exposed to water when the hood 5 is closed.

The embodiment of the present disclosure has been described above, but the present disclosure is not limited to the above embodiment. For example, the following modified embodiment may be adopted.

The above embodiment has described a configuration in which the first locking part 81 and the second locking part 82 separately include the operators 811 and 821, respectively, but is not limited to such a configuration. The first locking part 81 and the second locking part 82 may include one common operator, and may be configured to transmit the operating force of the one operator to each engagement part 8B of the first locking part 81 and the second locking part 82.

The above embodiment has described a configuration in which the first operator 811 and the second operator 821 are lever members, but is not limited to such a configuration. The first operator 811 and the second operator 821 may each be a dial member, a knob member, a member into which a push-pull operation is input, or the like, instead of the lever member. The first operator 811 and the second operator 821 may have a structure including an electric switch sensor and an actuator that moves the engagement part 8B with respect to the engaged part 8C in response to the switch sensor.

The above embodiment has exemplified the engine 3 having an internal combustion engine as a propulsion drive source for the personal watercraft 1, but a propulsion drive source other than the engine 3 may be used. For example, a drive source using an electric motor or a hybrid drive source of an electric motor and an engine may be used.

The above embodiment has shown an example where the personal watercraft 1 is a jet-propelled-type boat. The personal watercraft 1 according to the present disclosure may be a personal watercraft other than the jet-propelled-type. The above embodiment has exemplified the stand-up type personal watercraft 1. The personal watercraft 1 may be a straddle-type personal watercraft.

The specific embodiment described above includes the disclosure having the following configuration.

A personal watercraft according to a first aspect of the present disclosure includes: a watercraft body provided with a deck including a driver boarding portion and an opening forming portion in which an opening is formed forward of the driver boarding portion and an engine room is partitioned below the opening; a hood to which a steering shaft is attached to cause a handle to be exposed upward, the hood covering the opening from above to allow opening and closing by pivoting with respect to the deck by using a front end supported by the opening forming portion as a fulcrum; and a locking mechanism configured to fix a rear end of the hood with the opening closed to the deck. The locking mechanism includes a first locking part and a second locking part that are disposed with spacing in a left-right direction.

According to the first aspect, with the hood closing the opening, the rear end of the hood is fixed to the deck by the first locking part and the second locking part disposed with spacing in the left-right direction. This allows the coupling strength between the hood and the deck to be increased. Therefore, even if stress such as torsional stress due to the operation of the handle by the driver is applied to the hood, the coupled state between the hood and the deck can be maintained. This allows the state where the hood closes the opening to be maintained during driving in response to the handle operation by the driver.

In a personal watercraft according to a second aspect, the first locking part is disposed leftward of the steering shaft, and the second locking part is disposed rightward of the steering shaft in the personal watercraft according to the first aspect.

According to the second aspect, the rear end of the hood can be fixed to the deck by the first locking part and the second locking part on both sides of the steering shaft. This allows the coupled state between the hood and the deck to be maintained more securely.

In a personal watercraft according to a third aspect, each of the first locking part and the second locking part is disposed rearward of the handle in the personal watercraft according to the first or second aspect.

According to the third aspect, even if stress due to the handle operation by the driver is applied to the hood, the coupled state between the hood and the deck can be maintained more securely.

In a personal watercraft according to a fourth aspect, each of the first locking part and the second locking part includes an operator that is operated to switch between a locked state in which the rear end of the hood is fixed to the deck, and an unlocked state in which the fixation of the rear end of the hood to the deck is released in the personal watercraft according to the first to third aspects. The hood is configured to open the opening when the operator of both the first locking part and the second locking part is in the unlocked state.

According to the fourth aspect, for the hood to open the opening, the operator of both the first locking part and the second locking part has to be in the unlocked state. In this case, even if one operator enters the unlocked state due to unintended contact by the driver, if the other operator is in the locked state, it is possible to prevent the hood from opening. This makes it easy to prevent the hood from opening undesirably.

In a personal watercraft according to a fifth aspect, each of the first locking part and the second locking part includes an operator that is operated to switch between a locked state in which the rear end of the hood is fixed to the deck, and an unlocked state in which the fixation of the rear end of the hood to the deck is released in the personal watercraft according to the first to third aspects. The operator is configured to switch to the unlocked state by an operation of being moved in a pulling direction including upward or rearward.

According to the fifth aspect, during driving in response to the handle operation by the driver, the operator is unlikely to be operated in the pulling direction. In this case, even if the driver during driving touches the operator, the operator is unlikely to enter the unlocked state, making it easy to prevent the hood from opening undesirably.

In a personal watercraft according to a sixth aspect, each of the first locking part and the second locking part includes an operator that is operated to switch between a locked state in which the rear end of the hood is fixed to the deck, and an unlocked state in which the fixation of the rear end of the hood to the deck is released in the personal watercraft according to the first to third aspects. The operator is accommodated in a recess formed in the hood or the deck.

According to the sixth aspect, the operator is accommodated in the recess. In this case, even if the driver's body nears the operator due to a change in the posture during driving, the surrounding of the recess can prevent the driver's body from touching the operator, making it easy to prevent the hood from opening undesirably.

In a personal watercraft according to a seventh aspect, the locking mechanism is a mechanism configured to fix the rear end of the hood to an upper end of a rear wall portion located rearward of the opening in the opening forming portion in the personal watercraft according to the first to third aspects. The first locking part includes a first lever member that is attached to a left corner of the rear end of the hood and pivots up and down to allow a posture change between a coupled posture to be coupled to the upper end of the rear wall portion and an uncoupled posture to release the coupling. The second locking part includes a second lever member that is attached to a right corner of the rear end of the hood and pivots up and down independently of the first lever member to allow a posture change between a coupled posture to be coupled to the upper end of the rear wall portion and an uncoupled posture to release the coupling.

According to the seventh aspect, the first lever member and the second lever member are configured to pivot independently of each other. Therefore, even if one lever member adopts the uncoupled posture due to unintended contact by the driver, the other lever member can maintain the coupled posture. This makes it easy to prevent the hood from opening undesirably.

In a personal watercraft according to an eighth aspect, each of the first lever member and the second lever member is configured to adopt the uncoupled posture by pivoting upward in the personal watercraft according to the seventh aspect.

According to the eighth aspect, during driving in response to the handle operation by the driver, the driver is unlikely to touch the lever member such that the lever member pivots upward. In this case, even if the driver during driving touches the lever member, the lever member is unlikely to adopt the uncoupled posture, making it easy to prevent the hood from opening undesirably.

In a personal watercraft according to a ninth aspect, each of the first lever member and the second lever member has a shape to regulate protrusion from the upper end of the rear wall portion to the driver boarding portion with the coupled posture adopted in the personal watercraft according to the seventh or eighth aspect.

According to the ninth aspect, it is possible to avoid the lever member protruding toward the driver boarding portion side in a state where the lever member adopts the coupled posture. This makes it easy to prevent the driver during driving from touching the lever member, and to prevent the hood from opening undesirably.

In a personal watercraft according to a tenth aspect, the rear end of the hood includes a first recess formed at a left corner to be recessed upward while being open rearward and downward, and a second recess formed at a right corner to be recessed upward while being open rearward and downward in the personal watercraft according to the seventh to ninth aspects. The first lever member is attached inside the first recess, and the second lever member is attached inside the second recess.

According to the tenth aspect, the upper, left, and right sides of the lever member are covered with the recesses. In this case, even if the driver's body nears the lever member due to a change in the posture during driving, the surrounding of the recess can prevent the driver's body from touching the lever member, making it easy to prevent the hood from opening undesirably.

A personal watercraft according to an eleventh aspect further includes: a hinge member that is attached forward of the opening in the opening forming portion and pivotably supports the hood by fixing the front end of the hood in the personal watercraft according to the first to tenth aspects. The hinge member includes a stopper configured to regulate a pivoting range of the hood.

The eleventh aspect allows the stopper to regulate the pivoting of the hood beyond the pivoting range, making it possible to prevent the hood from opening excessively with respect to the opening. In addition, by providing the hinge member that supports the hood with the stopper, it is easier to prevent damage to the hood than in the case where the hood is provided with the stopper.

A personal watercraft according to a twelfth aspect further includes: a holding member disposed forward of the opening in the opening forming portion to hold a state where the hood is open in the personal watercraft according to the eleventh aspect. The hinge member includes a fitting part into which the holding member is fitted.

According to the twelfth aspect, by fitting the holding member in the fitting part, it is possible to hold the state where the hood is open.

A personal watercraft according to a thirteenth aspect further includes: an explosion proof valve that is attached to the hood and is opened by an increase in internal pressure of the engine room; and a cover member attached to the hood and covering the steering shaft in the personal watercraft according to the first to twelfth aspects. The cover member has a shape that covers the explosion proof valve in addition to the steering shaft.

According to the thirteenth aspect, the explosion proof valve is attached to the hood. In this case, it is possible to suppress the stress applied to the hood as the internal pressure of the engine room increases by opening the explosion proof valve. This makes it possible, when the internal pressure of the engine room increases, to suppress coupling force between the hood and the deck necessary to prevent the hood from opening and to maintain the state where the hood closes the engine room. In addition, the cover member for covering the steering shaft also covers the explosion proof valve, making it possible to protect the explosion proof valve and to improve the aesthetic appearance of the personal watercraft.

A personal watercraft according to a fourteenth aspect further includes: a breather pipe having one end open to outside above the hood and another end communicating with the engine room in the personal watercraft according to the thirteenth aspect. The cover member covers the breather pipe.

According to the fourteenth aspect, the breather pipe can discharge air inside the engine installed inside the engine room above the hood. The cover member for covering the steering shaft also covers the breather pipe, making it possible to protect the breather pipe and to improve the aesthetic appearance of the personal watercraft.

A personal watercraft according to a fifteenth aspect further includes: a water intrusion prevention plate disposed between the front end of the hood and the opening forming portion in the personal watercraft according to the first to fourteenth aspects.

According to the fifteenth aspect, the water intrusion prevention plate can prevent water from intruding through the gap between the front end of the hood and the opening forming portion.

A personal watercraft according to a sixteenth aspect further includes: a waterproof sealing member disposed at a boundary between the hood and the opening forming portion; and an accommodation storage attached to an inner surface of the hood and capable of accommodating goods in the personal watercraft according to the first to fifteenth aspects.

According to the sixteenth aspect, it is possible to take out goods from the accommodation storage with the hood open, and to prevent the goods inside the accommodation storage from being exposed to water with the hood closed.

In a personal watercraft according to a seventeenth aspect, the deck includes a protruding part protruding upward on both sides of the driver boarding portion, and the protruding part has a processed area with an anti-slip finish applied in the personal watercraft according to the first to sixteenth aspects.

According to the seventeenth aspect, the driver can board the driver boarding portion from the underwater while holding the protruding part. In this case, the protruding part includes the processed area, making it easier for the driver to board the driver boarding portion while holding the protruding part.

In a personal watercraft according to an eighteenth aspect, the processed area is an area including an upper surface of the protruding part in the personal watercraft according to the seventeenth aspect.

According to the eighteenth aspect, the upper surface of the protruding part is the processed area, making it easier for the driver to board the driver boarding portion while holding the protruding part.

In a personal watercraft according to a nineteenth aspect, the processed area is formed by adhering a matte material to which a matte finish is applied as the anti-slip finish to the protruding part, and the matte material is adhered across the driver boarding portion and the protruding part in the personal watercraft according to the seventeenth or eighteenth aspect.

According to the nineteenth aspect, the processed area of the protruding part can be formed using the matte material adhered to the driver boarding portion.

A personal watercraft according to a twentieth aspect includes: a watercraft body provided with a deck including a driver boarding portion and an opening forming portion in which an opening is formed forward of the driver boarding portion and an engine room is partitioned below the opening; a hood to which a steering shaft is attached to cause a handle to be exposed upward, the hood covering the opening from above to allow opening and closing by pivoting with respect to the deck by using a front end supported by the opening forming portion as a fulcrum; an explosion proof valve that is attached to the hood and is opened by an increase in internal pressure of the engine room; and a cover member attached to the hood and covering the steering shaft. The cover member has a shape that covers the explosion proof valve in addition to the steering shaft.

According to the twentieth aspect, the explosion proof valve is attached to the hood. In this case, it is possible to suppress the stress applied to the hood as the internal pressure of the engine room increases by opening the explosion proof valve. This makes it possible, when the internal pressure of the engine room increases, to suppress coupling force between the hood and the deck necessary to prevent the hood from opening and to maintain the state where the hood closes the engine room. In addition, the cover member for covering the steering shaft also covers the explosion proof valve, making it possible to protect the explosion proof valve and to improve the aesthetic appearance of the personal watercraft.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A personal watercraft comprising:

a watercraft body including a deck including a driver boarding portion and an opening forming portion in which an opening is formed forward of the driver boarding portion, an engine room being partitioned below the opening;

a hood to which a steering shaft is attached to cause a handle to be exposed upward, the hood covering the opening from above to allow opening and closing by pivoting with respect to the deck by using a front end supported by the opening forming portion as a fulcrum; and a locking mechanism configured to fix a rear end of the hood with the opening closed to the deck;

wherein:

the locking mechanism includes a first locking part and a second locking part that are disposed with spacing in a left-right direction, the first locking part includes a first lever that pivots up and down to allow a posture change between a coupled posture to be coupled to an upper end of a rear wall portion located rearward of the opening in the opening forming portion and an uncoupled posture to release the coupled posture, and the second locking part includes a second lever that pivots up and down to allow a posture change between a coupled posture thereof to be coupled to the upper end of the rear wall portion and an uncoupled posture thereof to release the coupled posture thereof, and the rear end of the hood includes a first recess being open rearward and a second recess being open rearward and downward, the first lever is attached inside the first recess, and the second lever is attached inside the second recess.

2. The personal watercraft according to claim 1, wherein;

the first locking part is disposed leftward of the steering shaft, and the second locking part is disposed rightward of the steering shaft.

3. The personal watercraft according to claim 1, wherein:

each of the first locking part and the second locking part is disposed rearward of the handle.

4. The personal watercraft according to claim 1, wherein:

each of the first locking part and the second locking part includes an operator that is operated to switch between a locked state in which the rear end of the hood is fixed to the deck, and an unlocked state in which a fixation of the rear end of the hood to the deck is released, and the hood is configured to open the opening when the operator of both the first locking part and the second locking part is in the unlocked state.

5. The personal watercraft according to claim 1, wherein;

each of the first locking part and the second locking part includes an operator that is operated to switch between a locked state in which the rear end of the hood is fixed to the deck, and an unlocked state in which a fixation of the rear end of the hood to the deck is released, and the operator is configured to switch to the unlocked state by an operation of being moved in a pulling direction including upward or rearward.

6. The personal watercraft according to claim 1, wherein:

each of the first locking part and the second locking part includes an operator that is operated to switch between a locked state in which the rear end of the hood is fixed to the deck, and an unlocked state in which a fixation of the rear end of the hood to the deck is released, and the operator is accommodated in a recess formed in the hood or the deck.

7. The personal watercraft according to claim 1, wherein:

the locking mechanism is a mechanism configured to fix the rear end of the hood to the upper end of the rear wall portion, the first lever is attached to a left corner of the rear end of the hood, and the second lever is attached to a right corner of the rear end of the hood.

8. The personal watercraft according to claim 7, wherein:

each of the first lever and the second lever is configured to adopt the uncoupled posture by pivoting upward.

9. A personal watercraft comprising:

a watercraft body provided with a deck including a driver boarding portion and an opening forming portion in which an opening is formed forward of the driver boarding portion and an engine room is partitioned below the opening;

a hood to which a steering shaft is attached to cause a handle to be exposed upward, the hood covering the opening from above to allow opening and closing by pivoting with respect to the deck by using a front end supported by the opening forming portion as a fulcrum; and a locking mechanism configured to fix a rear end of the hood with the opening closed to the deck;

wherein:

the locking mechanism includes a first locking part and a second locking part that are disposed with spacing in a left-right direction, the first locking part includes a first lever that pivots up and down to allow a posture change between a coupled posture to be coupled to an upper end of a rear wall portion located rearward of the opening in the opening forming portion and an uncoupled posture to release the coupled posture, the second locking part includes a second lever that pivots up and down to allow a posture change between a coupled posture thereof to be coupled to the upper end of the rear wall portion and an uncoupled posture thereof to release the coupled posture thereof, and a rear end of each of the first lever and the second lever is located forward of a rear end of the upper end of the rear wall portion in the coupled posture.

10. The personal watercraft according to claim 7, wherein:

the first recess is at a left corner to be recessed upward while being open both rearward and downward, and the second recess is at a right corner.

11. The personal watercraft according to claim 1, further comprising:

a hinge that is attached forward of the opening in the opening forming portion and pivotably supports the hood by fixing the front end of the hood, wherein the hinge includes a stopper configured to regulate a pivoting range of the hood.

12. The personal watercraft according to claim 11, further comprising:

a holder disposed forward of the opening in the opening forming portion to hold a state where the hood is open, wherein the hinge includes a fitting part into which the holder is fitted.

13. The personal watercraft according to claim 1, further comprising:

an explosion proof valve that is attached to the hood and is opened by an increase in internal pressure of the engine room; and a cover attached to the hood and covering the steering shaft, wherein the cover has a shape that covers the explosion proof valve in addition to the steering shaft.

14. The personal watercraft according to claim 13, further comprising:

a breather pipe having one end open to outside above the hood and another end communicating with the engine room, wherein the cover covers the breather pipe.

15. The personal watercraft according to claim 1, further comprising:

a water intrusion prevention plate disposed between the front end of the hood and the opening forming portion.

16. The personal watercraft according to claim 1, further comprising:

a waterproof seal disposed at a boundary between the hood and the opening forming portion; and an accommodation storage attached to an inner surface of the hood and capable of accommodating goods.

17. The personal watercraft according to claim 1, wherein:

the deck includes a protruding part protruding upward on both sides of the driver boarding portion, and the protruding part includes a processed area with an anti-slip finish.

18. The personal watercraft according to claim 17, wherein;

the processed area includes an upper surface of the protruding part.

19. The personal watercraft according to claim 17, wherein;

the processed area includes a matte material with a matte finish which is the anti-slip finish, the matte material adhered to the protruding part, and the matte material is adhered across the driver boarding portion and the protruding part.

20. A personal watercraft comprising:

a watercraft body including a deck including a driver boarding portion and an opening forming portion in which an opening is formed forward of the driver boarding portion, an engine room being partitioned below the opening;

a hood to which a steering shaft is attached to cause a handle to be exposed upward, the hood covering the opening from above to allow opening and closing by pivoting with respect to the deck by using a front end supported by the opening forming portion as a fulcrum;

an explosion proof valve that is attached to the hood and is opened by an increase in internal pressure of the engine room; and a cover attached to the hood and covering the steering shaft, wherein the cover has a shape that covers the explosion proof valve in addition to the steering shaft.

* * * * *